US006019870A

United States Patent [19]

Devic et al.

[11] Patent Number: 6,019,870

[45] Date of Patent: Feb. 1, 2000

[54] PROCESS FOR THE PREPARATION OF DELIGNIFIED AND BLEACHED CHEMICAL PAPER PULPS

[75] Inventors: Michel Devic, Sainte-Foy-les-Lyon; Jean-Pierre Schirmann, Paris, both of France

[73] Assignee: Elf Atochem S.A., Puteaux, France

[21] Appl. No.: 08/737,684

[22] PCT Filed: Apr. 14, 1995

[86] PCT No.: PCT/FR95/00494

§ 371 Date: Jan. 17, 1997

§ 102(e) Date: Jan. 17, 1997

[87] PCT Pub. No.: WO95/31599

PCT Pub. Date: Nov. 23, 1995

[30] Foreign Application Priority Data

May 11, 1994 [FR] France ..... 94/05815

[51] Int. Cl.[7] ..... D21C 9/147; D21C 9/16

[52] U.S. Cl. ..... 162/65; 162/76; 162/78; 162/80

[58] Field of Search ..... 162/76, 78, 80, 162/65

[56] References Cited

U.S. PATENT DOCUMENTS

| | | | |
|---|---|---|---|
| 4,244,778 | 1/1981 | Lindahl et al. | 162/78 |
| 5,310,458 | 5/1994 | Lundgren et al. | 162/76 |

FOREIGN PATENT DOCUMENTS

| | | | |
|---|---|---|---|
| 0 577 157 A2 | 1/1994 | European Pat. Off. . | |
| 0 578 304 B1 | 9/1996 | European Pat. Off. . | |
| 56-58086 | 5/1981 | Japan | 162/78 |
| 79/00861 | 11/1979 | WIPO | 162/78 |

OTHER PUBLICATIONS

*Using Oxygen and Peroxide to Bleach Kraft Pulps*, B. Van Lierop, N. Liebergott and M.G. Faubert, Journal of Pulp and Paper Science, vol. 20, No. 7, pp. J193–J198.

*Chemicals, Dry Solids and Solid Waste in Low Effluent Bleach Mills*, B. Dillner, Helsinki, Finland, Feb. 16, 1994, p. 9.

*Chlorine and Chlorine Dioxide Replacements in Kraft Pulp Bleaching: Emerging Technologies or Laboratory Curiosities?*, C.L. Forber, Bleaching: A TAPPI Press Anthology of Published Papers, Chapter 6, pp. 443–451 (1993).

*P*: One–Stage Hydrogen Peroxide Full Bleaching of Previously Delignified Softwood Kraft Pulp, Application to TCF Sequences*, by F. Desprez, J. Devenyns and N. Troughton, TAPPI Proceedings, 1993 Pulping Conference Book 2, Nov. 1–3, 1993, pp. 443–452.

*TCF Bleaching Can Be Carried Out with Different Bleaching Systems*, by P. Tibbling and B. Dillner, XXV. Eucepa Conference, Oct. 4–8, 1993, Vienna, Austria, pp. 65–83.

*Optimization of Bleaching Sequences Using Peroxide as First Stage*, by D. Lachenal, L. Soria, C. de Choudens, and P. Monzie, TAPPI Proceedings, 1982 International Pulp Bleaching Conference, pp. 145–151.

*Non Degrading TCF Bleaching Sequences Including an Ozone Stage for Hardwood and Softwood Kraft Pulps, and Characterization of the Effluents*, by C. Chirat and D. Lachenal, TAPPI Proceedings, 1993 Pulping Conference Book 2, Nov. 1–3, 1993, pp. 717–723.

*Primary Examiner*—Steven Alvo

[57] ABSTRACT

A process of dignifying lignocellulosic pulp with oxygen followed by treatment of the delignified pulp with a chelating agent, followed by washing, followed by treatment with hydrogen peroxide at an alkaline pH in the presence of an alkali metal silicate at a temperature greater than 100° C. and a pressure greater than 1.5 times the saturated vapor pressure.

18 Claims, 8 Drawing Sheets

PROCESS FOR THE PREPARATION OF DELIGNIFIED AND BLEACHED CHEMICAL PAPER PULPS

The invention related to a process for the preparation of a delignified and bleached chemical paper pulp.

Chemical paper pulps or chemical pulps are those obtained by cooking lignocellulose materials, in particular wood. Thus it is that the following are distinguished among the chemical pulps:

kraft or sulphate pulps, sulphite or bisulphite pulps, semi-chemical or neutral sulphite pulps, pulps after cooking with a solvent, such as those obtained by the Organosolv process (Ullmann's Encyclopedia of Industrial Chemistry, 5th Edition, vol. A. 18, 1991, pages 568 and 569), sulphite-anthraquinone pulps, "Superbatch" pulps.

All types of wood are suitable:

softwoods, such as the various species of pines and firs, hardwoods, such as, for example, birch, poplar, beech and eucalyptus.

Chemical pulps obtained by cooking are conventionally subjected to a number of dignifying and/or bleaching treatment stages.

The first stages consist in completing the delignification resulting from the cooking. The following stages are bleaching stages.

On conclusion of these dignifying and bleaching treatments, the pulps should usually have a whiteness of at least 88–90° ISO and a very low kappa number while retaining good mechanical properties, that is to say without significant degradation of the cellulose. This degradation can be detected by measuring the viscosity of the pulp or else its degree of polymerization (DP). The DP should remain as high as possible.

The definitions of the terms used above and subsequently correspond to the following standards:

Whiteness: ISO standard 2470

Kappa number: SCAN standard C1-59

Degree of polymerization (DP): SCAN standard C 15–12

The first dignifying stages are usually carried out by treatments with chlorine gas or chlorine dioxide.

For the preparation of chlorine-free pulps, it has been proposed to replace the chlorinated reactants with other oxidizing agents. The article by C. L. Forber, "Chlorine and chlorine dioxide replacements in kraft pulp bleaching: Emerging technologies or Laboratory curiosities?, TAIPPI Press, Atlanta, Ga. 1993", concludes that a number of compounds exist which have a sufficient bleaching ability for replacing chlorine in delignification but that the replacement of chlorine dioxide in bleaching does not seem achievable as no reactant is as effective and as inexpensive as chlorine dioxide.

This article shows in particular the comparative dignifying and bleaching abilities of a series of reactants, such as chlorine, chlorine dioxide, oxygen, ozone and hydrogen peroxide, and also shows the results obtained, generally in terms of kappa number, whiteness and viscosity.

Thus, oxygen alone has a dignifying ability and no significant bleaching ability. Its chlorine replacement factor (CRF) is 5 and its use results in the kappa number decreasing by approximately a half (17 from 35), the viscosity obtained being 980 $dm^3$/kg (approximately 37 cps) and the whiteness 34° ISO.

In comparison, the use of hydrogen peroxide is known both in delignification and bleaching.

In delignification, the kappa number decreases by a little less than half (20 from 35), the viscosity obtained being 900 and more $dm^3$/kg (approximately 30 cps) and the whiteness 45° ISO; 91° ISO is obtained for a viscosity of approximately 600 and more $dm^3$/kg.

In order to lower the kappa number below a value usually of between 7 and 14, it is necessary to resort to a second dignifying stage which can be carried-out with ozone (C. Chirat and Lachenal, TAPPI Proceedings, Pulping Conference, 1993, p. 717) or else with peracetic acid or alternatively with Caro's acid (F. Desprez, S. Devenyns, N. Troughton, TAPPI Proceedings, Pulping Conference, 1993, p. 443).

A treatment with hydrogen peroxide, as described in Patent Application EP 0,578,304 A1, only makes it possible to strongly bleach pulps in which the kappa number is less than 5, in which the manganese content is less than or equal to 3 ppm and in which the consistency is at least 25% by weight of dry matter with respect to the total weight of the pulp. This treatment with $H_2O_2$ is carried out at a claimed temperature between 50 and 140° C.

This manganese content less than or equal to 3 ppm is obtained by a pretreatment with a complexing or sequestering agent or acid in acid medium.

The temperatures given as examples are 80, 90 and 120° C. No corresponding information is given at this temperature of 120° C. on the pressure prevailing in the reaction mixture.

This pressure could be the saturated vapour pressure of water at the temperature shown.

The work: "American Institute of Physics Handbook, Third Edition, McGraw-Hill Book Company, page 4–309" shows the saturated vapour pressures of water for temperatures of between 100° C. and 374.15° C., in particular approximately 2 bars absolute for 120° C. and 3.6 bars absolute for 140° C.

Moreover, Examples 18 to 21 of EP 0,578,304 A1, involving a chemical pulp with a consistency of 30%, show that the DP decreases from 1180 to 1030 when the final whiteness increases from 89.8 to 92.6° ISO.

Patent Application EP 0,577,157 A2 describes a process for bleaching a pulp having a consistency of 5 to 20% with hydrogen peroxide in alkaline medium at a pressure of less than 25 bars and preferably of less than 14 bars.

However, this process requires a pretreatment with ozone under pressure.

The description and the figures do not report the heating means and it may be supposed that the treatment with $H_2O_2$ is carried out at the same ambient temperature as the pretreatment with ozone.

The article by P. Tibbling and B. Dillner, presented at the 25th EUCEPA conference in Vienna in 1993, shows that bleaching by $H_2O_2$ in alkaline medium, at a temperature of 90 to 110° C. and under a pressure of 5 bars, makes it possible to bleach pulps with a kappa number of 12 up to a whiteness of 85–86° ISO and pulps with a kappa number of 7 up to a whiteness of 90° ISO.

However, the gains in whiteness result in a significant decrease in the viscosity ($dm^3$/kg) of these pulps. FIG. 2 shows that the viscosity decreases from 890 to 760 when the ISO whiteness increases from approximately 78.3 to approximately 84.7. Moreover, an increase in the temperature from 100 to 110° C. does not seem to produce any significant effect.

The document Duoplan OY, Kvaerner by B. Dillner, "Chemicals dry solids and solid waste in a low effluent bleach mill, Study review meeting, Helsinki, Feb. 16, 1994" shows that PO bleachings carried out at 105° C. under a pressure of 5 to 10 bars do not result in significant pressure effects. However, the viscosity decreases from 970 to 800 when the whiteness increases from 73 to 87° ISO.

The aim of the present invention is to provide a process for the preparation of delignified and bleached chemical paper pulps having a high DP by using oxygen and hydrogen peroxide as oxidizing agents and by carrying out all the treatment stages of the process in reaction mixtures at basic pH. This process also has the aim of avoiding any stage involving a chlorinated derivative, such as, for example, chlorine or chlorine dioxide, and also of avoiding any treatment stage with other oxidizing agents, in particular ozone or peracids.

This aim is achieved according to the present invention by a process for the preparation of a delignified and bleached chemical paper pulp according to which a lignocellulose pulp obtained by cooking is subjected to the following series of treatments:

a) a dignifying treatment with oxygen, followed b) by a treatment with a complexing or sequestering agent for transition metals, followed by washing, then c) by a treatment with hydrogen peroxide, characterized in that the treatment with hydrogen peroxide is carried out in the presence of alkali metal silicate, at a temperature t greater than 100° C. and at a pressure p greater than 1.5 times the saturated vapour pressure of water at the temperature t.

This process makes it possible to prepare ECF and TCF pulps without having to resort to oxidizing agents other than oxygen or hydrogen peroxide.

The treatment with oxygen (a) or delignification with oxygen is now widely employed in the paper industry and in particular in the development of TCF and ECF pulps, as shown, for example, in the article by "Van Lierop, B., Oxygen delignification, Workshop on Emerging Pulping and Chlorine-free Technology, Raleigh N.C., March 1–4, 1993".

Delignification is generally limited to 50% (as measured by the kappa number) because, beyond this limit, the selectivity of the oxygen in medium of alkaline pH falls sharply and the cellulose is attacked, resulting in a harmful decrease in the degree of polymerization (DP). The conditions of the stage (a) of the process according to the invention are those known and used in the paper industry.

One or a number of stages of washing the pulp can be added to the end of the treatment with oxygen in medium of alkaline pH.

The treatment with oxygen can also be carried out in a number of successive stages with oxygen, separated by washing stages.

The complexing or sequestering treatment (b) according to the present invention is carried out by means of a complexing or sequestering agent for transition metals, such as, for example, DTPA (Sodium diethylenetriaminepentaacetate), EDTA (Sodium ethylenediaminetetraacetate) or the salts of phosphonic acids.

A number of agents can be combined in order to increase the effectiveness of the treatment with respect to a larger number of metals.

The amount of complexing or sequestering agent is advantageously from 0.1% to 1% by weight with respect to the dry matter contained in the pulp. This amount is preferably from 0.25 to 0.5%.

The amounts of products and reactants, unless otherwise specified, are always expressed in percent by weight with respect to the weight of the dry matter of the pulp or of the pulp considered in the dry state.

The consistency of the pulp is expressed in percent by weight of dry matter with respect to the total weight of the pulp.

The treatment b) is preferably carried out in a medium having an alkaline pH.

The pH of the pulp during the treatment b) is advantageously greater than 7 and less than or equal to 12.5.

The pH in b) is preferably from 8.5 to 9.5. The alkaline pH during the treatment in b) is obtained either by the residual alkalinity of the pulp on conclusion of the treatment with oxygen or by the alkalinity of the complexing or sequestering agent or alternatively by the addition of a base, for example NaOH.

For the majority of pulps, the residual alkalinity of the pulp, combined with that of DTPA, makes it possible to obtain a pH in the region of 9 without the addition of sodium hydroxide.

The manganese content of the pulp before the treatment with hydrogen peroxide c) preferably does not exceed 5 ppm by weight with respect to the weight of dry matter of this same pulp.

The temperature of the treatment b) is generally from 20 to 100° C. and the preferred temperature from 60 to 90° C.

The duration of the treatment b) is generally from 1 to 30 minutes and preferably from 5 to 15 minutes.

The consistency of the pulp during the treatment b) is generally from 2 to 25% and the preferred consistency is from 4 to 12%.

On conclusion of the complexing treatment, the pulp is washed with water. washing is carried out according to the known techniques of the paper industry with hot or cold water.

Surprisingly, the fact of carrying out the treatment c) under pressure makes it possible to minimize the attack of the cellulose material of the pulp, and to retain a high DP, unlike the results obtained in the prior art.

The kappa number of the pulp before treatment with hydrogen peroxide advantageously does not exceed 17. Indeed, the process then makes it possible, in a final stage P, to obtain a delignified pulp of high whiteness which can be directly used in the manufacture of paper.

The pressure p is advantageously from 5 to 200 bars absolute. This pressure range makes it possible to observe an advantage in maintaining a high DP when the process according to the invention is implemented.

Preferably, for practical operating reasons, the pressure p is from 25 to 50 bars absolute.

The alkali metal silicate is advantageously sodium silicate.

When sodium silicate is used, it is preferable, for reasons of convenience, to use from 0.5 to 10% by weight of a 380 Bé commercial solution with respect to the weight of the dry matter and better still from 4 to 8% by weight of this solution.

The reaction temperature t is advantageously from 110° C. to 180° C. The preferred t range is from 130° C. to 160° C.

The pulp, during the treatment with hydrogen peroxide, advantageously has a consistency of 4 to 35% by weight of dry matter with respect to the total weight of the wet pulp. The process can be carried out efficiently at low consistencies approximately from 4 to approximately 10% and the very fluid reaction mixture can be easily moved about by pumping while avoiding any blinding.

The consistency is preferably from 10 to 20%. This consistency range makes it possible to optimize the throughput of the process.

The treatment with hydrogen peroxide advantageously has a duration of 1 minute to 3 hours. The duration varies inversely with the increase in the temperature.

The duration is preferably from 15 minutes to 1 hour. These relatively short durations make it possible to increase the hourly throughput in the manufacture of the delignified and bleached pulp.

Depending on the starting pulp used and the temperature of the process, the hydrogen peroxide is advantageously used in an amount of 0.5 to 10% by weight with respect to the weight of the dry matter of the pulp.

The dignifying and bleaching stage c) according to the invention is implemented continuously or non-continuously (batch) by means of the devices generally employed in the paper industry for cooking pulps and which make it possible to keep the pulp, impregnated with the aqueous hydrogen peroxide and sodium silicate solution, at a high pressure and at a high temperature for the chosen duration. After this treatment c), the pulp is decompressed, cooled and washed with water.

For example, the batch bleaching of the high-consistency pulp (20 to 30%) can be carried out in the following way:

The pulp is mixed while cold with hydrogen peroxide and sodium silicate and water so as to obtain the chosen consistency and then introduced into a stainless steel autoclave so as to fill it as completely as possible. After closing the autoclave, a small amount of water is pumped until a pressure of approximately ten bars is obtained and then the temperature is brought to the chosen temperature for the chosen time. During the temperature rise stage, the expansion of the liquids causes an increase in pressure. This increase can be controlled by discharging a small amount of the liquid phase during the heating.

For example, the continuous bleaching of the low-consistency pulp (8–10%) can be carried out in the following way:

The DTPA-pretreated pulp is washed and mixed with hydrogen peroxide, silicate and water in order to have a consistency of 8 to 10% which makes it possible for the pulp to be able to be pumped.

The mixture is then introduced under pressure, via a high-pressure pump, into the reactor via a heat exchanger which brings the mixture to the chosen temperature. On leaving the tubular reactor, the length of which is calculated so as to provide the chosen duration of the bleaching, the bleached pulp is decompressed and cooled by diluting with water and is then washed.

Subsidiary devices such as heat exchangers and steam recovery cyclones can be added in order to recover and enhance the value of the heat and the pressure of the pulp on conclusion of the bleaching.

The preferred method of the present invention provides a new sequence $OQ_{basic}P$, the P stage being novel per se.

This preferred sequence exhibits technical advantages because, in the techniques of the prior art, it is necessary to complex or sequestrate the metals in acid medium in order to be able to bleach to high levels, with hydrogen peroxide.

Patent Application EP 578,304 A, already mentioned above, shows that a treatment in acid medium at controlled pH is necessary before being able to carry out the final stage with hydrogen peroxide. All the examples of EP 578,304 report a complexing treatment at acid pH or else an acid washing at pH 5 before the final bleaching.

Moreover, D. Lachenal et al., "Optimization of bleaching sequences using peroxide as first stage, 1982, International Pulp Bleaching Conference, TAPPI Proceedings, p. 145–150", show (Table 4, p. 147) that an acid pretreatment also makes it possible to improve the delignification of the pulp during the bleaching with peroxide.

The preferred embodiment of the present invention makes it possible to obtain an excellent result as regards bleaching without an acid medium being necessary in the stage b), in contrast to the general teaching of the prior art.

The fact of being able to carry out the treatment b) in basic medium is of great industrial advantage because this avoids two changes in pH during the sequence. Indeed, on conclusion of the alkaline treatment with oxygen, the pH of the pulp is basic, even after a number of washings with water, and this makes it possible to avoid a second neutralization of the acidity of the complexing treatment with sodium hydroxide.

Finally, this preferred sequence makes it possible to eliminate the problems of corrosion of steel equipment in acid medium and decreases the problems regarding the treatment of residual salts and acids for the sake of respecting the environment.

Stage c), carried out according to the characteristics of the invention, makes it possible, by virtue of the use of a pressure p greater than the saturated vapour pressure of water, to avoid any significant evaporation of the liquid reactants.

In the conventional processes, for temperatures exceeding 100° C., the pressure results from a liquid/vapour equilibrium which develops after the evaporation of part of the liquid phase during the heating. The silicate/high temperature/pressure p combination makes it possible unexpectedly to obtain a significant delignification while retaining a good DP for the pulp. Consequently, an attack of the lignin is thus obtained with a selectivity comparable to that of chlorine gas or of chlorine dioxide.

The process according to the present invention thus makes it possible to obtain virtually complete delignification and bleaching of chemical pulps after cooking in only 3 stages and in using only inexpensive oxidizing agents, namely oxygen and hydrogen peroxide.

The invention will be better understood with the help of the examples, of Tables I to X.

EXAMPLES

Examples 1 to 46, which appear in Tables I to X, were carried out starting with three chemical pulps of industrial origin obtained by kraft cooking and treatment with oxygen.

The treatment with oxygen of the pulps was carried out according to the conventional conditions at a consistency of 10%, under an oxygen pressure of 3.5 bars, at a temperature of 95° C. and for a duration of 60 to 90 minutes, depending on the nature of the wood.

The characteristics of these pulps are reported below in Table A:

TABLE A

| Nature of the pulp after cooking and treatment with oxygen | pH of the pulp | Consistency in % | Kappa Number | DP | Whiteness *ISO |
|---|---|---|---|---|---|
| Softwood kraft (SK) | 9.4 | 27 | 13.1 | 1010 | 34.5 |
| Hardwood kraft (HKI) | 8.7 | 31 | 9.2 | 1160 | 53.7 |
| Hardwood kraft (HKII) | 9.6 | 28 | 7.4 | 1170 | 44.9 |

General procedure of all the examples (unless otherwise mentioned):

a) Complexing Treatment

The pulp chosen in Table A is suspended at a consistency of 10% with 0.5% of DTPA (commercial solution containing 40% by weight of DTPA in water) and heated for 15 minutes (0.25 hour) at 90° C.

The final pH is from 9 to 9.6, depending on the pulp chosen.

The chosen pulp is then filtered and washed with demineralized water.

b) Bleaching Under Pressure

The pulp collected in a) is mixed at ambient temperature with the charge of hydrogen peroxide, of sodium silicate and of demineralized water necessary to obtain the consistency chosen for the test, and the reaction mixture thus obtained is then placed in a stainless steel autoclave which is completely filled with the pulp, the dead space being reduced as much as possible. A few $cm^3$ of demineralized water are pumped into the autoclave in order to achieve the chosen pressure. The autoclave is then heated at the temperature t for the chosen duration.

The heating has the effect of increasing the internal pressure. In order to maintain the pressure at the chosen reaction value, the closing valve of the autoclave is intermittently opened in order to allow a few $cm^3$ of liquid to escape. After reaction, the autoclave is cooled and opened. The pulp is collected on a filter and washed with demineralized water. The whiteness, kappa number and DP measurements are then carried out according to the ISO standards of the paper industry recalled above.

Discussion of the results obtained:

1) Influence of the amount of sodium silicate on the whiteness obtained and the DP Table I shows Tests 1 (comparative), 2, 3, 4 and 5 carried out on the HKI pulp.

Table II shows Tests 6, 7, 8, 9, 11, 10, 12 and 13 carried out on the HKII pulp.

Figure 1:
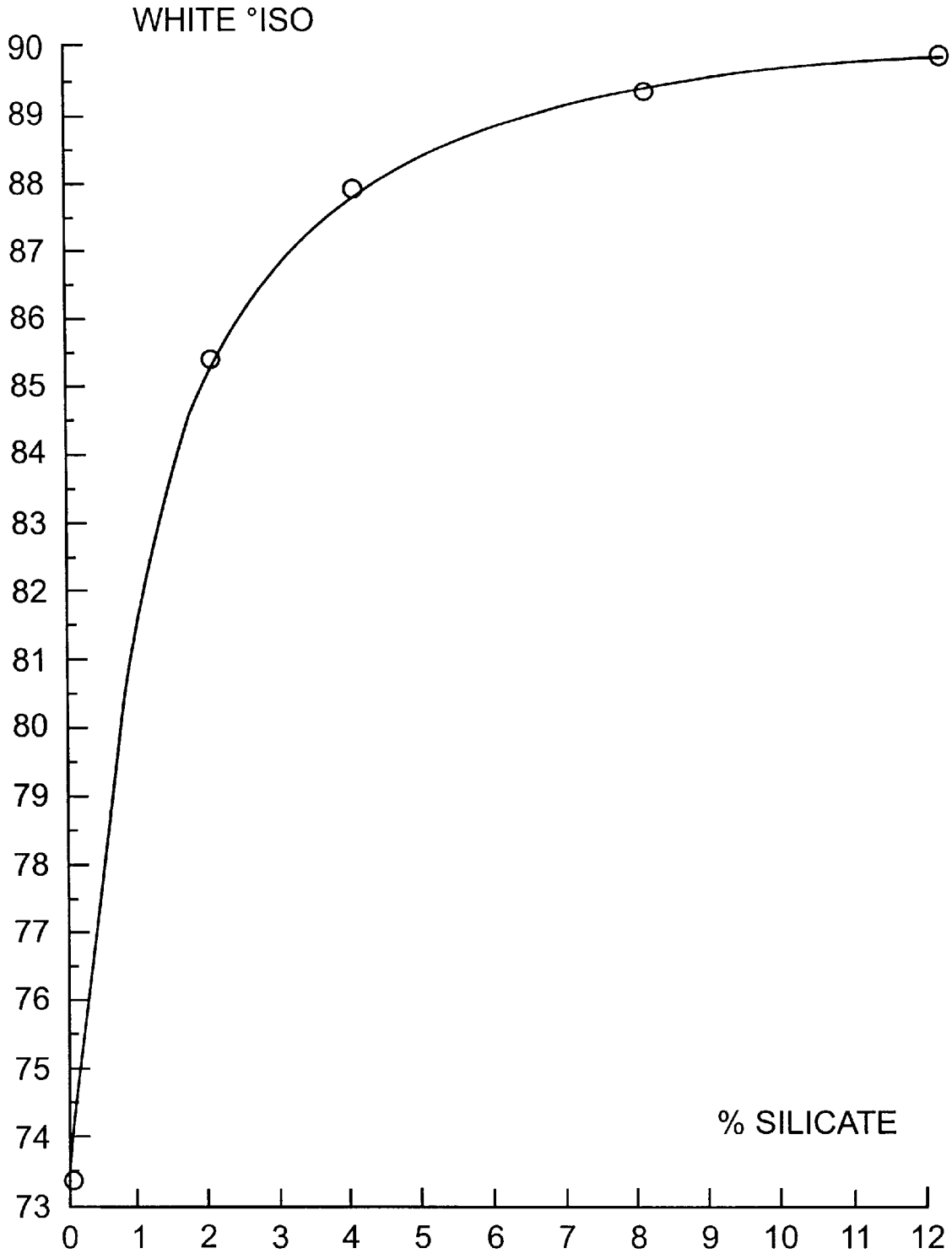
FIGS. 1, 2 and 3 show the beneficial effect of sodium silicate.
Figure 2:
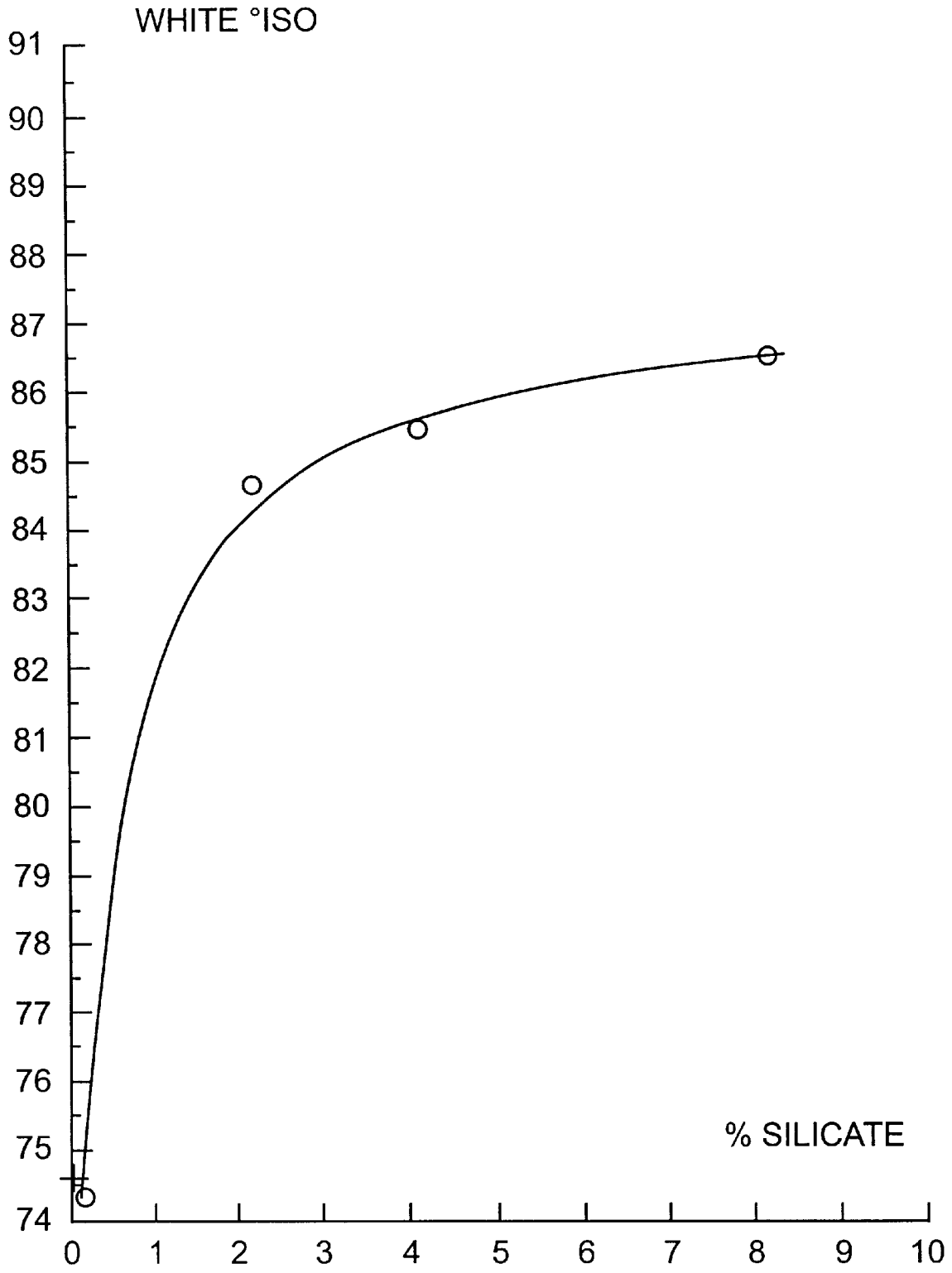
Figure 3:
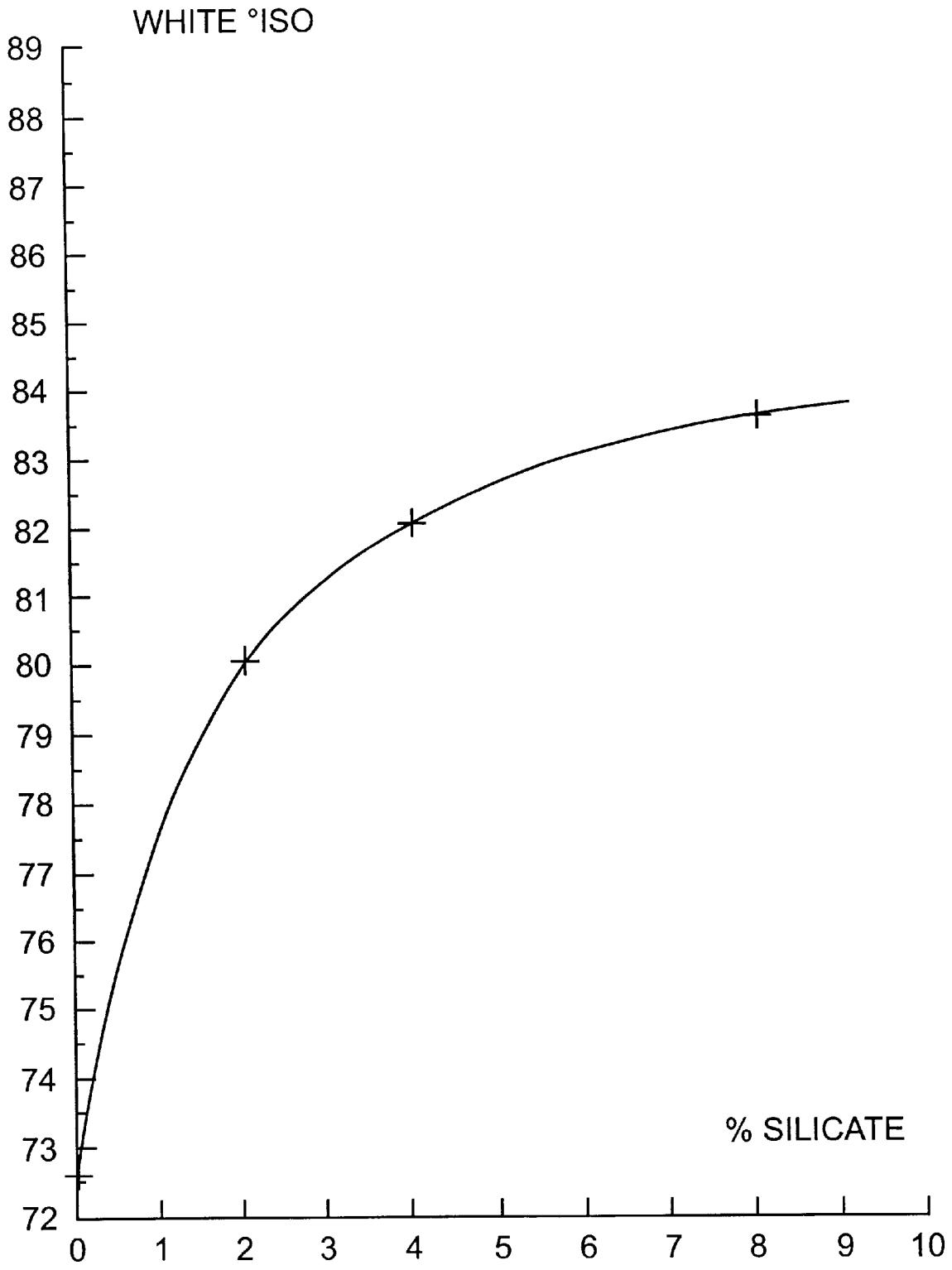

FIGS. 1, 2 and 3, based on the tests below, clearly show the very significant beneficial effect of the sodium silicate and this effect becomes more significant as the bleaching temperature increases.

Curve 2, for example, shows that, for a temperature of 150° C. and at 25 bars, the addition of 2% of silicate makes it possible to gain 10 ISO whiteness points.

Comparison of Test 1 (comparative, 0% of silicate) and of Test 4 (8% of silicate) shows that, in addition to the very high gain in whiteness (73.5 to 89.2° ISO), the degree of polymerization of the pulp is virtually retained with the silicate (DP=1100) whereas, under the same conditions but without silicate, the DP of the pulp falls to 148. The addition of 2% of silicate (Test 2) makes it possible to greatly increase the whiteness (85.4° ISO) but the DP remains low (DP=372). With 4% of silicate, the DP shows a slightly smaller fall (Test 3, DP=720).

2) Influence of the pressure and of the temperature on whiteness

Table III shows Tests 14, 15, 16, 17, 18, 19, 4, 20 and 21 carried out on the HKI pulp.

Tables IV and X show Tests 13, 22, 23, 24, 25, 26, 27, 45 and 46 carried out on the HKII pulp.

Figure 4:
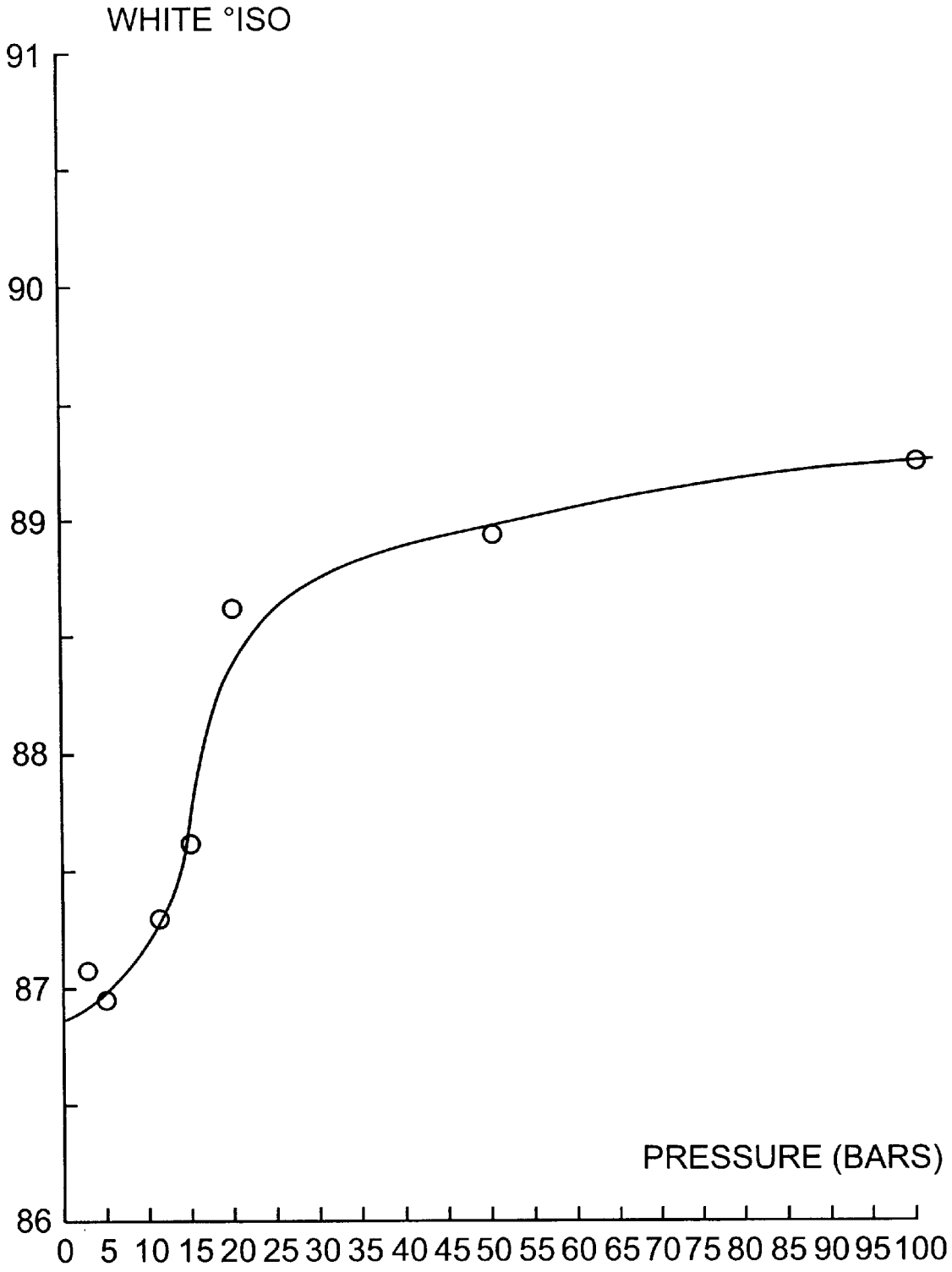
FIGS. 4, 5 and 6 show the beneficial effect of pressure.
Figure 5:
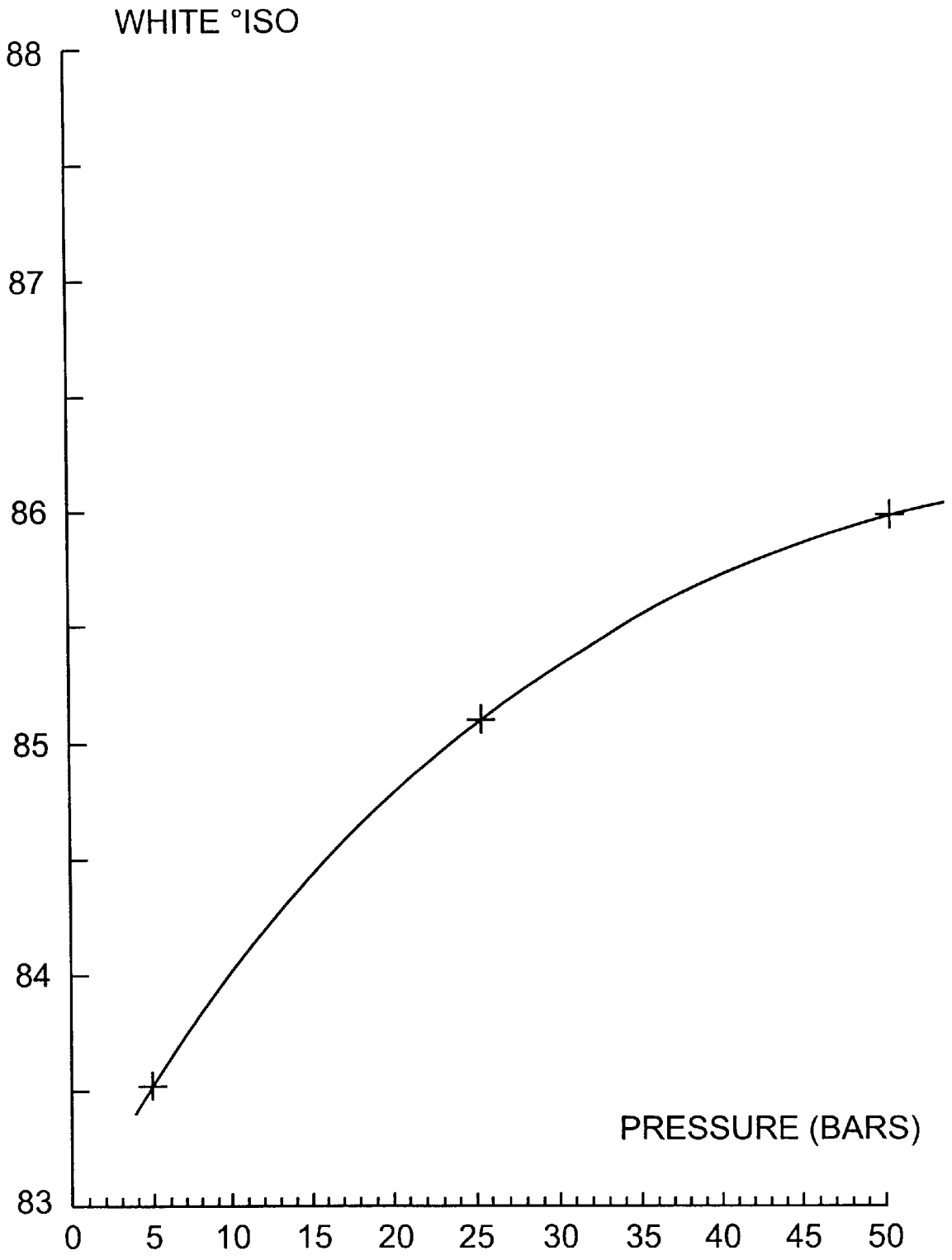
Figure 6:
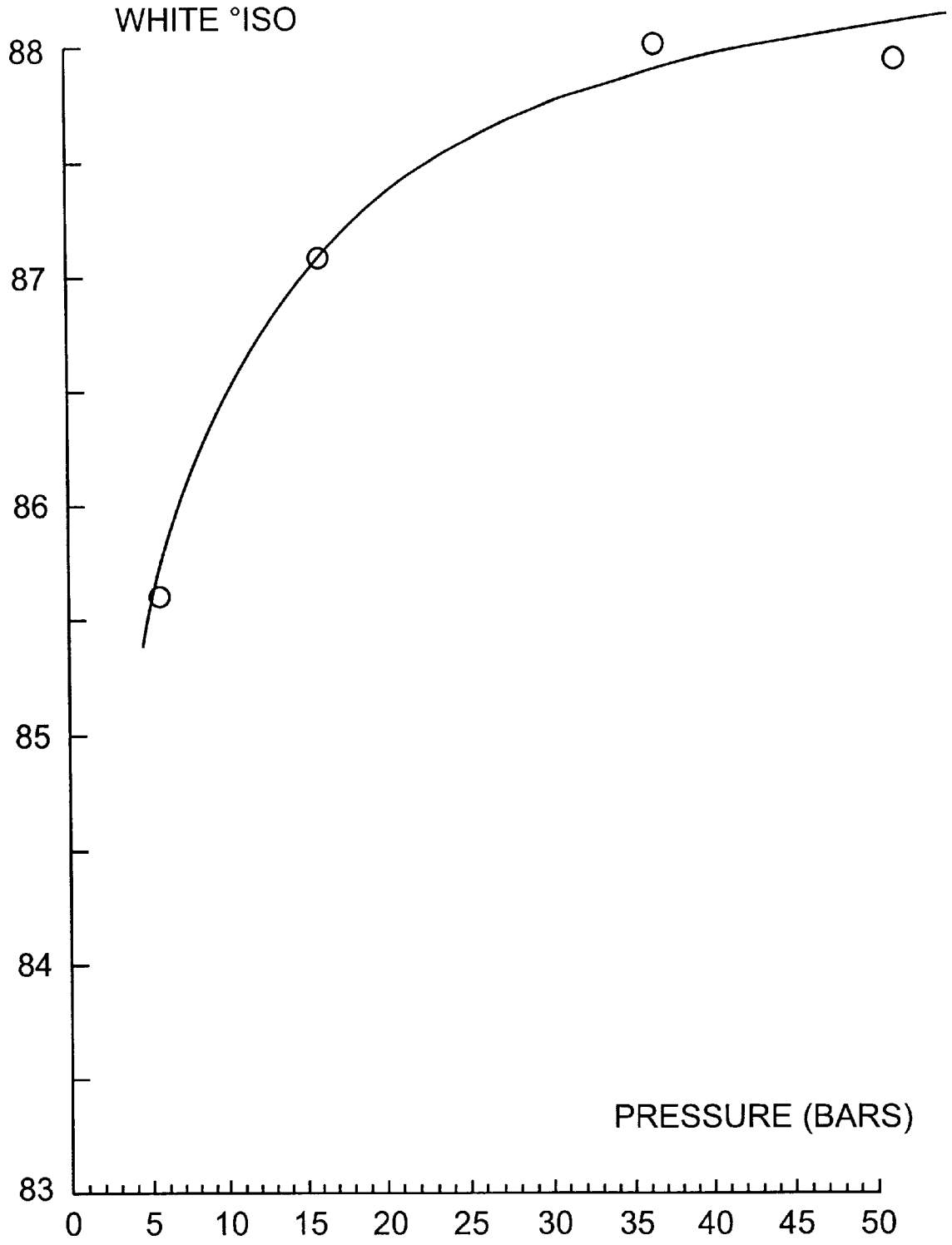

FIGS. 4, 5 and 6, based on the tests below, clearly show the beneficial effect of the pressure.

It is observed that the effect is more significant from 5 to 50 bars especially. It is therefore preferable to exceed a pressure of 5 bars. This effect is recognizable from 110° C. to 150° C.

Curves 5 and 6 also show that, for the same pulp and for conditions which are moreover identical, an increase in the temperature increases the whiteness.

The use of very high bleaching temperatures, such as 170° C., makes it possible to obtain very high degrees of ISO whiteness. This result contrasts with the observations of the bleaching of mechanical pulps, for which the best whitenesses are obtained at temperatures of between 60 and 90° C.

3) Influence of the amount of hydrogen peroxide

Table V shows Tests 28, 4, 29 and 30 carried out on the HKI pulp.

Figure 7:
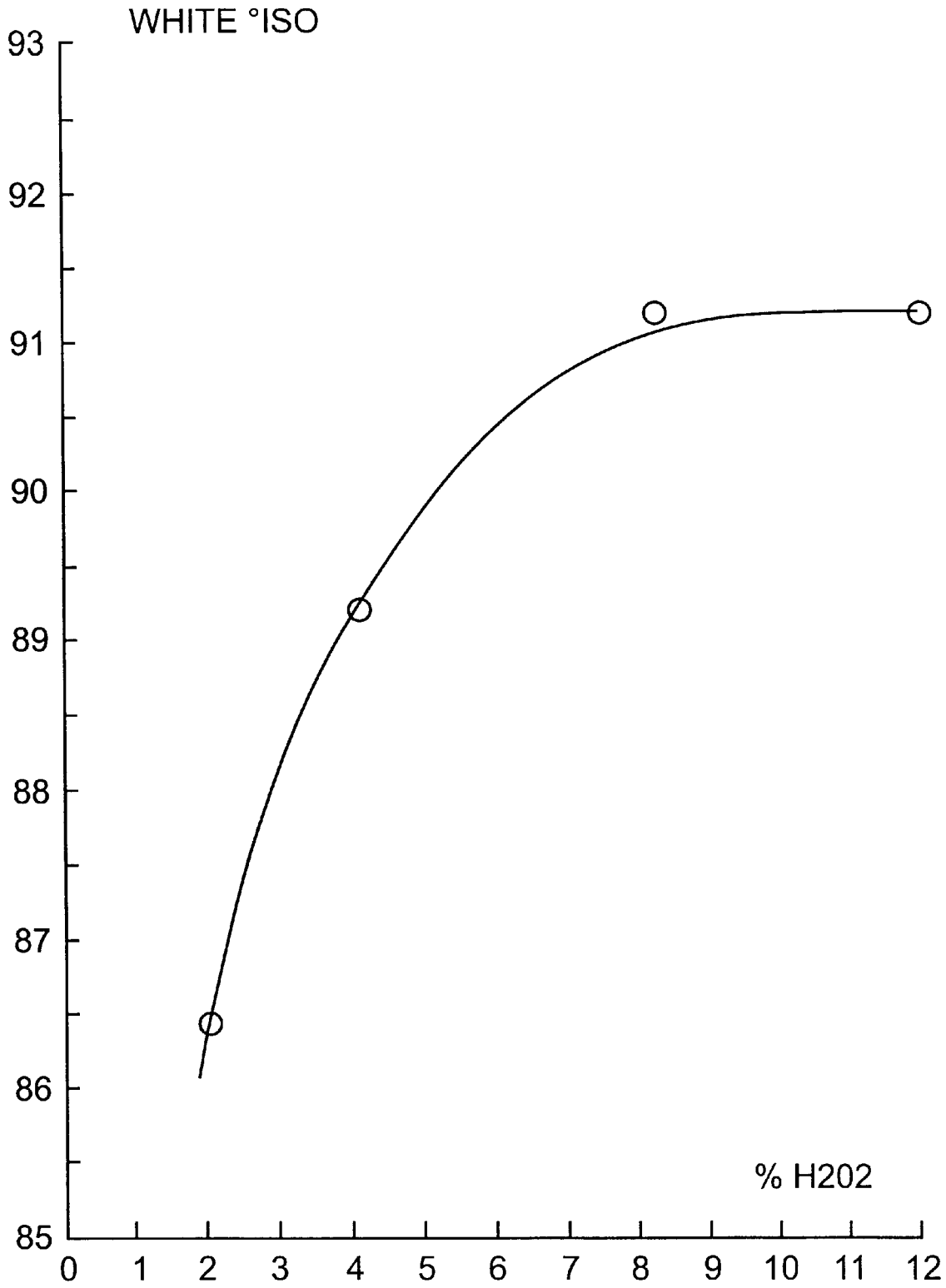
FIG. 7 shows the effect of % by weight $H_2O_2$.
Figure 8:
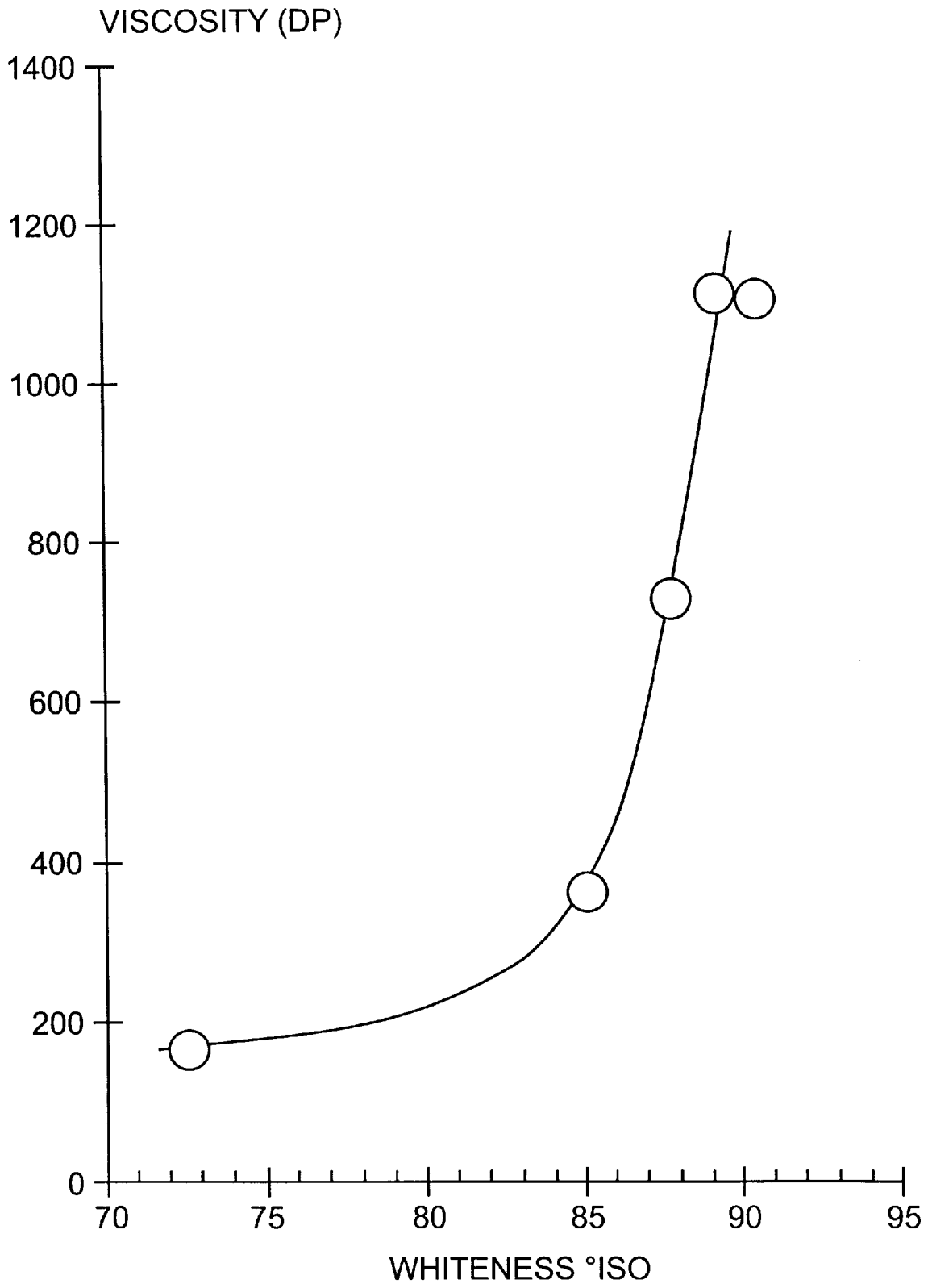
FIG. 8 shows Viscosity (DP) vs. Whiteness or Brightness (ISO).

FIG. 7, based on the above tests, shows a significant effect up to 8% by weight of $H_2O_2$ used in the reaction mixture.

4) Relationship between whiteness and the DP

The tests in Table I will make it possible to trace the DP curve as a function of the °ISO whiteness. It will be noted that the viscosities increase when the whiteness increases, for a temperature of 130° C. and a pressure of 100 bars absolute. This result is novel and unexpected with respect to the teaching of the prior art cited above. Indeed, it was not foreseeable that, in the presence of silicate, sodium silicate would make it possible to retain a good DP under high temperature and strong pressure conditions.

Table VI shows the tests carried out on the HKII pulp (Tests 31, 32, 33, 34 and 35).

Table VII shows tests carried out on the HKI pulp (Tests 36, 37, 20 and 38).

Table VIII shows tests carried out on the HKI pulp (Tests 39, 21, 40, 2, 41, 45 and 46).

Table IX shows tests carried out on the SK pulp (Tests 42, 43 and 44).

Discussion of the other examples

Tests 34 and 35 in Table VI show that the addition of magnesium (1% of magnesium sulphate) has a harmful effect on the table.

Tests 31 and 32 in Table VI show that the addition of sodium hydroxide (1% of NaOH) has a harmful effect on whiteness.

Test 36 in Table VII and Test 46 in Table X show that the addition of an additional amount of DTPA during the stage b) of the action of $H_2O_2$ improves the whiteness very slightly.

Comparative Test 39 in Table VIII, carried out at atmospheric pressure and at low temperature (90° C.), results in a whiteness which is much lower (79.2° ISO) than that obtained with the same amounts of reactants in Test 31 (88.6° ISO).

Test 38 in Table VII, carried out at low temperature but at high pressure, gives, for the same amounts of reactants, a better whiteness (81.9° ISO) but one which is much lower than that obtained with the conditions of the present invention (Test 31 in Table VI, 150° C., 100 bars, 88.6° ISO).

Test 41 in Table VIII, carried out under the same experimental conditions as Test 4 in Table I but at a consistency of 9.5% instead of 20%, shows that, even at low consistency (pumpable pulp), the bleaching remains effective, which is not the case for the action of $H_2O_2$ at atmospheric pressure.

Table IX shows the tests carried out on the SK softwood kraft pulp at very low initial whiteness 34.5° ISO.

Test 44 shows that the conditions of the invention (temperature of 150° C., pressure of 100 bars and 8% of silicate) make it possible to obtain a high whiteness (89.0° ISO), i.e. a gain of 54.5° ISO, and a virtually complete delignification (kappa number equal to 1.2). Test 43 shows that with 4% of $H_2O_2$, a gain of 43.8° ISO is still obtained.

Tests 23, 26 and 45 show that, for the same pulp, the efficiency of the bleaching increases with the temperature. At 170° C., a whiteness of 88.3° ISO is obtained on heating for only 20 minutes.

TABLE I

| Test No. | Time in hours | t in ° C. | Consistency in % | Complexing agent in % DTPA | $H_2O_2$ in % | 38° Bé Silicate in % | Pressure of the reaction in bars | Final pH | Kappa | DP | White ISO % |
|---|---|---|---|---|---|---|---|---|---|---|---|
| 1* | a) 0.25 | 90 | 10 | 0.5 | — | — | — | 8.9 | — | — | — |
| | b) 1 | 130 | 20 | — | 4 | 0 | 100 | 3.5 | 1.5 | 148 | 73.5 |
| 2 | a) 0.25 | 90 | 10 | 0.5 | — | — | — | 8.8 | — | — | — |
| | b) 1 | 130 | 20 | — | 4 | 2 | 100 | 4.2 | 1.9 | 372 | 85.4 |
| 3 | a) 0.25 | 90 | 10 | 0.5 | — | — | — | 9.1 | — | — | — |
| | b) 1 | 130 | 20 | — | 4 | 4 | 100 | 6.4 | 3.5 | 720 | 87.8 |
| 4 | a) 0.25 | 90 | 10 | 0.5 | — | — | — | 8.9 | — | — | — |
| | b) 1 | 130 | 20 | — | 4 | 8 | 100 | 8.2 | 4.3 | 1100 | 89.2 |
| 5 | a) 0.25 | 90 | 10 | 0.5 | — | — | — | 8.8 | — | — | — |
| | b) 1 | 130 | 20 | — | 4 | 12 | 100 | 8.6 | 4.03 | 1094 | 89.6 |

*Comparative test

TABLE II

| Test No. | Time in hours | t in ° C. | Consistency in % | Complexing agent in % DTPA | $H_2O_2$ in % | 38° Bé Silicate in % | Pressure of the reaction in bars | Final pH | Kappa | White ISO % |
|---|---|---|---|---|---|---|---|---|---|---|
| 6* | a) 0.25 | 90 | 10 | 0.5 | — | — | — | 9.3 | — | — |
| | b) 0.50 | 150 | 20 | — | 4 | 0 | 25 | 4.1 | 1.1 | 74.4 |
| 7 | a) 0.25 | 90 | 10 | 0.5 | — | — | — | 9.3 | — | — |
| | b) 0.50 | 150 | 20 | — | 4 | 2 | 25 | 5.1 | 1.2 | 84.7 |
| 8 | a) 0.25 | 90 | 10 | 0.5 | — | — | — | 9.4 | — | — |
| | b) 0.50 | 150 | 20 | — | 4 | 4 | 25 | 7 | 2.2 | 85.5 |
| 9 | a) 0.25 | 90 | 10 | 0.5 | — | — | — | 9.3 | — | — |
| | b) 0.50 | 150 | 20 | — | 4 | 8 | 25 | 7.5 | 2.8 | 86.5 |
| 10* | a) 0.25 | 90 | 10 | 0.5 | — | — | — | 9.4 | — | — |
| | b) 2 | 110 | 20 | — | 4 | 0 | 5 | 4.5 | 1.9 | 72.6 |
| 11 | a) 0.25 | 90 | 10 | 0.5 | — | — | — | 9.5 | — | — |
| | b) 2 | 110 | 20 | — | 4 | 2 | 5 | 6.6 | 2.9 | 80.0 |
| 12 | a) 0.25 | 90 | 10 | 0.5 | — | — | — | 9.5 | — | — |
| | b) 2 | 110 | 20 | — | 4 | 4 | 5 | 7.6 | 3.6 | 82.0 |
| 13 | a) 0.25 | 90 | 10 | 0.5 | — | — | — | 9.5 | — | — |
| | b) 2 | 110 | 20 | — | 4 | 8 | 5 | 9 | 3.5 | 83.5 |

*Comparative test

TABLE III

| Test No. | Time in hours | t in ° C. | Consistency in % | Complexing agent in % DTPA | $H_2O_2$ in % | 38° Bé Silicate in % | Pressure of the reaction in bars | Final pH | Kappa | DP | White ISO % |
|---|---|---|---|---|---|---|---|---|---|---|---|
| 14 | a) 0.25 | 90 | 10 | 0.5 | — | — | — | 8.9 | — | — | — |
| | b) 1 | 130 | 20 | — | 4 | 8 | 2.5–3 | 7.9 | 4.2 | 1170 | 87.1 |
| 15 | a) 0.25 | 90 | 10 | 0.5 | — | — | — | 8.8 | — | — | — |
| | b) 1 | 130 | 20 | — | 4 | 8 | 5 | 8 | 4.4 | — | 86.9 |
| 16 | a) 0.25 | 90 | 10 | 0.5 | — | — | — | 8.9 | — | — | — |
| | b) 1 | 130 | 20 | — | 4 | 8 | 12 | 8 | 4.3 | — | 87.3 |
| 17 | a) 0.25 | 90 | 10 | 0.5 | — | — | — | 8.9 | — | — | — |
| | b) 1 | 130 | 20 | — | 4 | 8 | 15 | 7.9 | 4.4 | — | 87.6 |
| 18 | a) 0.25 | 90 | 10 | 0.5 | — | — | — | 8.9 | — | — | — |
| | b) 1 | 130 | 20 | — | 4 | 8 | 20 | 7.8 | 4.1 | — | 88.6 |
| 19 | a) 0.25 | 90 | 10 | 0.5 | — | — | — | 8.9 | — | — | — |
| | b) 1 | 130 | 20 | — | 4 | 8 | 50 | 7.9 | 4.2 | — | 88.9 |
| 4 | a) 0.25 | 90 | 10 | 0.5 | — | — | — | 8.9 | — | — | — |
| | b) 1 | 130 | 20 | — | 4 | 8 | 100 | 8.2 | 4.3 | 1100 | 89.2 |
| 20 | a) 0.25 | 90 | 10 | 0.5 | — | — | — | 9.1 | — | — | — |
| | b) 1 | 130 | 20 | — | 4 | 4 | 10 | 7 | 4.1 | 926 | 85.6 |
| 21 | a) 0.25 | 90 | 10 | 0.5 | — | — | — | 9 | — | — | — |
| | b) 1 | 130 | 20 | — | 4 | 4 | 200 | 6.2 | 3.05 | 710 | 87.5 |

TABLE IV

| Test No. | Time in hours | t in ° C. | Consistency in % | Complexing agent in % DTPA | $H_2O_2$ in % | 38° Bé Silicate in % | Pressure of the reaction in bars | Final pH | Kappa | White ISO % |
|---|---|---|---|---|---|---|---|---|---|---|
| 13 | a) 0.25 | 90 | 10 | 0.5 | — | — | — | 9.5 | — | — |
| | b) 2 | 110 | 20 | — | 4 | 8 | 5 | 9 | 3.5 | 83.5 |
| 22 | a) 0.25 | 90 | 10 | 0.5 | — | — | — | 9.6 | — | — |
| | b) 2 | 110 | 20 | — | 4 | 8 | 25 | 8.9 | 3.5 | 85.1 |
| 23 | a) 0.25 | 90 | 10 | 0.5 | — | — | — | 9.5 | — | — |
| | b) 2 | 110 | 20 | — | 4 | 8 | 50 | 9.2 | 3.3 | 86.0 |
| 24 | a) 0.25 | 90 | 10 | 0.5 | — | — | — | 9.6 | — | — |
| | b) 1 | 150 | 20 | — | 4 | 8 | 5 | 7.6 | 2.9 | 85.6 |
| 25 | a) 0.25 | 90 | 10 | 0.5 | — | — | — | 9.6 | — | — |
| | b) 0.5 | 150 | 20 | — | 4 | 8 | 15 | 7.8 | 2.8 | 87.1 |
| 26 | a) 0.25 | 90 | 10 | 0.5 | — | — | — | 9.6 | — | |
| | b) 0.5 | 150 | 20 | — | 4 | 8 | 35 | 7.7 | 2.7 | 88.0 |
| 27 | a) 0.25 | 90 | 10 | 0.5 | — | — | — | 9.6 | — | — |
| | b) 0.5 | 150 | 20 | — | 4 | 8 | 50 | 7.5 | 2.7 | 87.9 |

TABLE V

| Test No. | Time in hours | t in ° C. | Consistency in % | Complexing agent in % DTPA | $H_2O_2$ in % | 38° Bé Silicate in % | Pressure of the reaction in bars | Final pH | Kappa | DP | White ISO % |
|---|---|---|---|---|---|---|---|---|---|---|---|
| 28 | a) 0.25 | 90 | 10 | 0.5 | — | — | — | 8.8 | — | — | — |
| | b) 1 | 130 | 20 | — | 2 | 8 | 100 | 8.1 | 4.4 | 1256 | 86.4 |
| 4 | a) 0.25 | 90 | 10 | 0.5 | — | — | — | 8.9 | — | — | — |
| | b) 1 | 130 | 20 | — | 4 | 8 | 100 | 8.2 | 4.3 | 1100 | 89.2 |
| 29 | a) 0.25 | 90 | 10 | 0.5 | — | — | — | 9.1 | — | — | — |
| | b) 1 | 130 | 20 | — | 8 | 8 | 100 | 7.4 | 3.3 | 830 | 91.2 |
| 30 | a) 0.25 | 90 | 10 | 0.5 | — | — | — | 8.8 | — | — | — |
| | b) 1 | 130 | 20 | — | 12 | 8 | 100 | 7.1 | 3.1 | 792 | 91.2 |

TABLE VI

| Test No. | Time in hours | t in ° C. | Consistency in % | Complexing agent in % DTPA | $H_2O_2$ in % | NaOH in % | 38° B Silicate % | Pressure of the reaction in bars | Other Products in % | Final pH | Kappa | DP | White ISO % |
|---|---|---|---|---|---|---|---|---|---|---|---|---|---|
| 31 | a) 0.25 | 90 | 10 | 0.5 | — | — | — | — | — | 9 | — | — | — |
| | b) 0.5 | 150 | 20 | — | 4 | — | 4 | 100 | — | 6.2 | 2.6 | 610 | 88.6 |
| 32 | a) 0.25 | 90 | 10 | 0.5 | — | — | — | — | — | 8.9 | — | — | — |
| | b) 0.5 | 150 | 20 | — | 4 | 1 | 4 | 100 | — | 9 | — | — | 85.6 |
| 33 | a) 0.50 | 90 | 3.7 | 0.5 | — | — | — | — | acetic | 6–7.2 | — | — | — |
| | b) 0.50 | 150 | 20 | — | 4 | — | 4 | 100 | acid | 6.1 | 2.3 | — | 88.8 |
| 34 | a) 0.50 | 90 | 15 | 0.5 | — | — | — | — | $H_2SO_4$ | 6–7.3 | — | — | — |
| | b) 0.50 | 150 | 20 | — | 4 | 2 | 4 | 100 | | 5.4 | 1.7 | — | 89.2 |
| 35 | a) 0.50 | 90 | 3 | 0.5 | — | — | — | — | $H_2SO_4$ | 6–7.2 | — | — | — |
| | b) 0.50 | 150 | 20 | — | 4 | — | 4 | 100 | $MgSO_4$ 1 | 5.4 | — | — | 82.1 |

TABLE VII

| Test No. | Time in hours | t in ° C. | Consistency in % | Complexing agent in % DTPA | $H_2O_2$ in % | 38° B Silicate % | Pressure of the reaction in bars | Final pH | Kappa | DP | White ISO % |
|---|---|---|---|---|---|---|---|---|---|---|---|
| 36 | a) 0.25 | 90 | 10 | 0.5 | — | — | — | 9 | — | — | — |
| | b) 0.5 | 150 | 20 | 0.2 | 4 | 4 | 100 | 7.2 | 2.8 | — | 88.7 |
| 37 | a) 0.25 | 90 | 10 | 0.5 | — | — | — | 9.1 | — | — | — |
| | b) 0.5 | 130 | 20 | — | 4 | 4 | 100 | 7.2 | 5 | 1090 | 85.3 |
| 20 | a) 0.25 | 90 | 10 | 0.5 | — | — | — | 9.1 | — | — | — |
| | b) 1 | 130 | 20 | — | 4 | 4 | 10 | 7 | 4.1 | 926 | 85.6 |
| 38* | a) 0.25 | 90 | 10 | 0.5 | — | — | — | 9 | — | — | — |
| | b) 2 | 90 | 20 | — | 4 | 4 | 100 | 8.5 | 5.4 | — | 81.9 |

*Comparative test

TABLE VIII

| Test No. | Time in hours | t in ° C. | Consistency in % | Complexing agent in % DTPA | $H_2O_2$ in % | 38° Bé Silicate in % | Pressure of the reaction in bars | Final pH | Kappa | DP | White ISO % |
|---|---|---|---|---|---|---|---|---|---|---|---|
| 39* | a) 0.25 | 90 | 10 | 0.5 | — | — | — | 9 | — | — | — |
| | b) 2 | 90 | 20 | — | 4 | 4 | 1 | 8.7 | 5.3 | — | 79.2 |
| 21 | a) 0.25 | 90 | 10 | 0.5 | — | — | — | 9 | — | — | — |
| | b) 1 | 130 | 20 | — | 4 | 4 | 200 | 6.2 | 3.05 | 710 | 87.5 |
| 40 | a) 0.25 | 90 | 10 | 0.5 | — | — | — | 9 | — | — | — |
| | b) 0.5 | 150 | 20 | — | 4 | 8 | 10 | 7.6 | 3.7 | 1010 | 89.0 |
| 2 | a) 0.25 | 90 | 10 | 0.5 | — | — | — | 8.8 | — | — | — |
| | b) 1 | 130 | 20 | — | 4 | 2 | 100 | 4.2 | 1.9 | 372 | 85.4 |
| 41 | a) 0.25 | 90 | 10 | 0.5 | — | — | — | 8.8 | — | — | — |
| | b) 1 | 130 | 9.5 | — | 4 | 8 | 100 | 8.6 | 4.15 | — | 87.2 |

*Comparative test

TABLE IX

| Test No. | Time in hours | t in ° C. | Consistency in % | Complexing agent in % | $H_2O_2$ in % | 38° Bé Silicate in % | Pressure of the reaction in bars | Final pH | Kappa | White ISO % |
|---|---|---|---|---|---|---|---|---|---|---|
| 42 | a) 0.25 | 90 | 10 | 0.5 | — | — | — | 9.4 | — | — |
| | b) 1 | 130 | 20 | — | 8 | 8 | 100 | 6.6 | 2 | 87.3 |
| 43 | a) 0.25 | 90 | 10 | 0.5 | — | — | — | 9.4 | — | — |
| | b) 0.5 | 150 | 20 | — | 4 | 8 | 10 | 7.1 | 2.6 | 78.3 |
| 44 | a) 0.25 | 90 | 10 | 0.5 | — | — | — | 9.6 | — | — |
| | b) 0.5 | 150 | 20 | — | 8 | 8 | 100 | 6.4 | 1.2 | 89.0 |

TABLE X

| Test No. | Time in hours | t in ° C. | Consistency in % | Complexing agent in % | $H_2O_2$ in % | 38° Bé Silicate in % | Pressure of the reaction in bars | Final pH | Kappa | White ISO % |
|---|---|---|---|---|---|---|---|---|---|---|
| 45 | a) 0.25 | 90 | 10 | 0.5 | — | — | — | 9.5 | — | — |
| | b) 0.5 | 170 | 20 | — | 4 | 8 | 35 | 7 | — | 88.3 |
| 46 | a) 0.25 | 90 | 10 | 0.5 | — | — | — | 9.5 | — | — |
| | b) 0.5 | 150 | 20 | 0.5 | 4 | 8 | 35 | 7.7 | — | 87.8 |

What is claimed is:

1. A process for the preparation of a delignified and bleached chemical paper pulp according to which a lignocellulose pulp obtained by cooking is subjected to the following series of treatments:

(a) a dignifying treatment with oxygen, followed by;

(b) a treatment with a complexing or sequestering agent for transition metals, followed by washing, then followed by;

(c) a treatment with hydrogen peroxide; characterized in that the treatment (b) is carried out in a medium having an alkaline pH greater or equal to 9.0 and less than or equal to 12.5, and the treatment c with hydrogen peroxide is carried out in the presence of an alkali metal silicate at a temperature t greater than 100° C. and at a pressure p greater than 1.5 times the saturated vapor pressure of water at the temperature t.

2. The process of claim 1, wherein the alkaline pH of the pulp during the treatment (b) greater or equal to 9.4 and less than or equal to about 12.5.

3. The process of claim 1, wherein the complexing or sequestering agent is DTPA.

4. The process of claim 1, wherein the complexing or sequestering agent used in the treatment (b) is present in an amount from about 0.1% to about 1% by weight with respect to the weight of dry matter of the said pulp.

5. The process of claim 4, wherein the complexing or sequestering agent used in the treatment (b) is present in an amount from about 0.25% to about 0.5% by weight with respect to the weight of dry matter of the said pulp.

6. The process of claim 1, wherein the manganese content of the pulp before treatment with hydrogen peroxide does not exceed about 5 ppm by weight with respect to the weight of dry matter.

7. The process of claim 1, wherein the pressure p is from about 5 to about 200 bars absolute.

8. The process of claim 7, wherein the pressure p is from about 25 to about 50 bars absolute.

9. The process of claim 1, wherein the alkali metal silicate is sodium silicate.

10. The process of claim 9, wherein the sodium silicate is added in the form of a 38° Bé aqueous solution in an amount from about 0.5% to about 10% by weight with respect to the weight of the dry matter.

11. The process of claim 10, wherein the sodium silicate is added in the form of a 38° Bé aqueous solution in an amount from about 4% to about 8% by weight with respect to the weight of the dry matter.

12. The process of claim 1, wherein the temperature t is from about 110° C. to about 180° C.

13. The process of claim 12, wherein the temperature t is from about 130° C. to about 160° C.

14. The process of claim 1, wherein the pulp, during the treatment (c) with hydrogen peroxide, has a consistency from about 4% to about 35% by weight with respect to the weight of the dry matter.

15. The process of claim 14, wherein the pulp, during the treatment (c) with hydrogen peroxide, has a consistency from about 10% to about 20% by weight with respect to the weight of the dry matter.

16. The process of claim 1, wherein the treatment (c) with hydrogen peroxide is of a duration from about 1 minute to about 3 hours.

17. The process of claim 16, wherein the treatment (c) with hydrogen peroxide is of a duration from about 15 minutes to about 1 hour.

18. The process of claim 1, wherein the hydrogen peroxide is added in an amount from about 0.5% to about 10% by weight with respect to the weight of the dry matter.

* * * * *